US005359396A

United States Patent [19]

Ogura et al.

[11] Patent Number: 5,359,396

[45] Date of Patent: Oct. 25, 1994

[54] TONER DENSITY DETECTION METHOD FOR ELECTROPHOTOGRAPHIC APPARATUS

[75] Inventors: Yoshio Ogura; Yasuyuki Tsuji; Shuuho Yokokawa; Kunitomo Takahashi; Isao Nakajima; Muneyoshi Akai; Hiroshi Ueno; Isao Watanabe; Tsukasa Onose, all of Ibaraki, Japan

[73] Assignee: Hitachi Koki Co., Ltd., Tokyo, Japan

[21] Appl. No.: 63,426

[22] Filed: May 19, 1993

[30] Foreign Application Priority Data

Jun. 12, 1992 [JP] Japan ..... 4-153357

[51] Int. Cl.[5] ..... G03G 21/00; G03G 15/06

[52] U.S. Cl. ..... 355/246

[58] Field of Search ..... 355/200, 245, 246, 260; 222/DIG. 1

[56] References Cited

U.S. PATENT DOCUMENTS 4,786,942 11/1988 Kusumoto et al. ..... 355/246 X
4,974,025 11/1990 Kikuchi ..... 355/246
5,006,893 4/1991 Yokoyama ..... 355/246 X
5,036,363 7/1991 Iida et al. ..... 355/246
5,047,804 9/1991 Komura ..... 355/246
5,091,749 2/1992 Iida et al. ..... 355/246

*Primary Examiner*—Fred L. Braun
*Attorney, Agent, or Firm*—Sughrue, Mion, Zinn, Macpeak & Seas

[57] ABSTRACT

A toner density detection method for an electrophotographic apparatus in which driving of a rotary roll provided at an outlet of a special vessel is continued for a predetermined period of time (e.g., several seconds) after the operation of the electrophotographic apparatus is stopped. All or substantially all of the developing agent is thus exhausted or removed from the special vessel after the electrophotographic apparatus is stopped, so that the true permeability of the developing agent can be detected by a permeability sensor when the operation of the electrophotographic apparatus is restarted. As a result, the toner density of the developing agent can be controlled and kept normal, so that the printing quality can be stabilized.

3 Claims, 2 Drawing Sheets

TONER DENSITY DETECTION METHOD FOR ELECTROPHOTOGRAPHIC APPARATUS

FIELD OF THE INVENTION

The present invention relates to a toner density detection method for electrophotographic apparatus.

BACKGROUND OF THE INVENTION

FIG. 2 is a schematic illustration of a well-known toner density detection apparatus for an electrophotographic apparatus. FIG. 3 shows the relationship between toner density and the permeability of a developing agent 6. The developing agent 6 is a mixture of toner 4 and carrier 5. FIG. 4 shows a conventional operational relationship between an electrophotographic apparatus and a rotary roll 3 of the toner density detection apparatus.

A toner density detection apparatus such as shown in FIG. 2 generally includes a permeability sensor 1, a special vessel 2 and a rotary roll 3. The toner density detection apparatus detects the toner density of a developing agent 6 consisting of a mixture of toner 4 and carrier 5 circulating inside the developer.

A portion of the developing agent 6 circulating inside the developer is fed into the special vessel 2, and the permeability of the developing agent 6 in the special vessel 2 is detected by the permeability sensor 1. The flow quantity and flow rate of the developing agent 6 in the special vessel 2 are kept constant by the rotary roll 3 provided at an outlet of the special vessel 2. Because the toner density and permeability of the developing agent 6 have a predetermined relationship as shown in FIG. 3, the toner density of the developing agent 6 can be determined by measuring the permeability with the permeability sensor 1. The operational relationship between the electrophotographic apparatus and the rotary roll 3 is shown in FIG. 4. As shown in FIG. 4, the electrophotographic apparatus and the rotary roll 3 are started at the same time and stopped at the same time.

In the conventional toner density detection method, when an instruction is given to stop operation of the electrophotographic apparatus, the rotating operation of the rotary roll 3 is stopped at the same time, as shown in FIG. 4. Thus, when the electrophotographic apparatus has been stopped, the special vessel 2 is full of developing agent 6. If the electrophotographic apparatus is not operated for a long period of time, the developing agent 6 inside the special vessel 2 can solidify due to the characteristics of the developing agent 6, the influence of the peripheral environment (high humidity), etc., so that it is difficult not only to exhaust the developing agent 6 out of the special vessel 2, but to supplement the developing agent circulating inside the developer into the special vessel 2 when the operation of the electrophotographic apparatus is restarted. As a result, it is impossible to detect the permeability, and it is likewise impossible to control the toner density. If the operation of the electrophotographic apparatus is continued in the above-mentioned state, various failures will occur in the quality of printing.

SUMMARY OF THE INVENTION

It is thus an object of the present invention to solve the above-mentioned problems in the prior art.

Specifically, it is an object of the present invention to provide a toner density detection method in which the true permeability of a developing agent is detected at all times so that the toner density of the developing agent can be controlled and kept normal, thus stabilizing the printing quality.

The foregoing and other objects of the present invention are attained by continuously driving the rotary roll after suspension of the operation of the electrophotographic apparatus for a predetermined time until all or substantially all of the developing agent has been exhausted or removed from the vessel.

In the toner density detection method of the present invention, the rotary roll provided at the outlet of the special vessel is driven for a predetermined time (e.g., several seconds) after the operation of the electrophotographic apparatus is stopped according to an operation-stop instruction given to the electrophotographic apparatus. Accordingly, it is possible to remove all or substantially all of the developing agent inside the special vessel to prevent solidification of the developing agent, even if the electrophotographic apparatus remains stopped for a long period of time. Thus, in the present invention, the developing agent inside the developer flows into the special vessel smoothly when the electrophotographic apparatus is restarted.

BRIEF DESCRIPTION OF THE DRAWINGS

Other features and advantages of the present invention will become apparent from the following description taken in connection with the accompanying drawings, wherein.

DETAILED DESCRIPTION OF THE PREFERRED EMBODIMENT

A preferred embodiment of the present invention will be described below with reference to the drawings.

Figure 1:
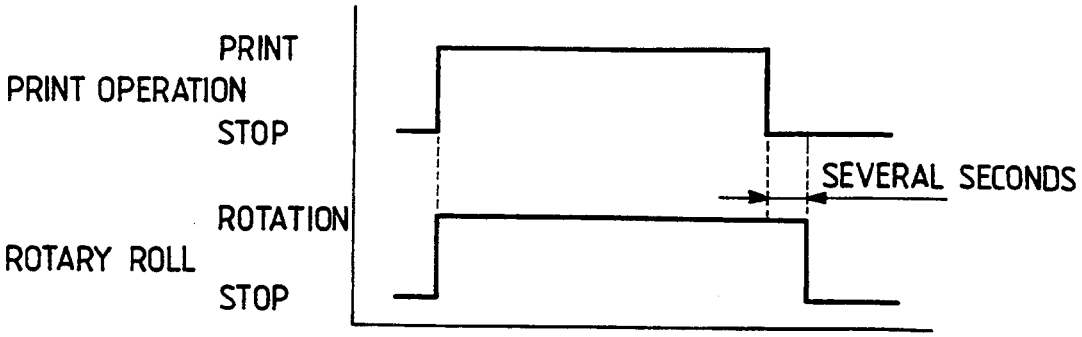
FIG. 1 is a graph illustrating the relationship between the printing operation and the operation of a rotary roll in a toner density detection method for an electrophotographic apparatus according to the present invention.
Figure 2:
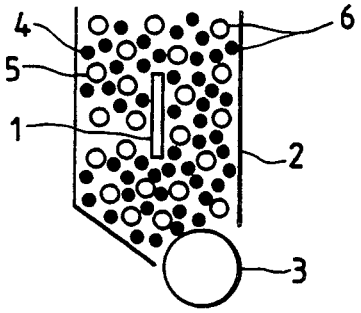
FIG. 2 PRIOR ART
FIG. 2 is a schematic diagram illustrating a conventional toner density detection apparatus in an electrophotographic apparatus.
Figure 3:
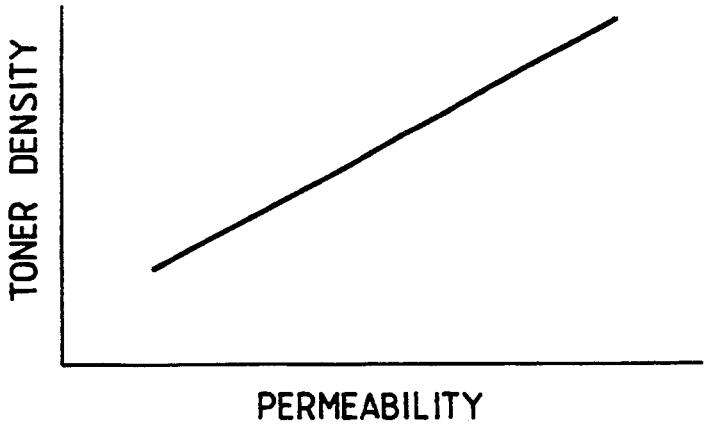
FIG. 3 PRIOR ART
FIG. 3 is a graph illustrating a relationship between the toner density of the developing agent and its permeability.
Figure 4:
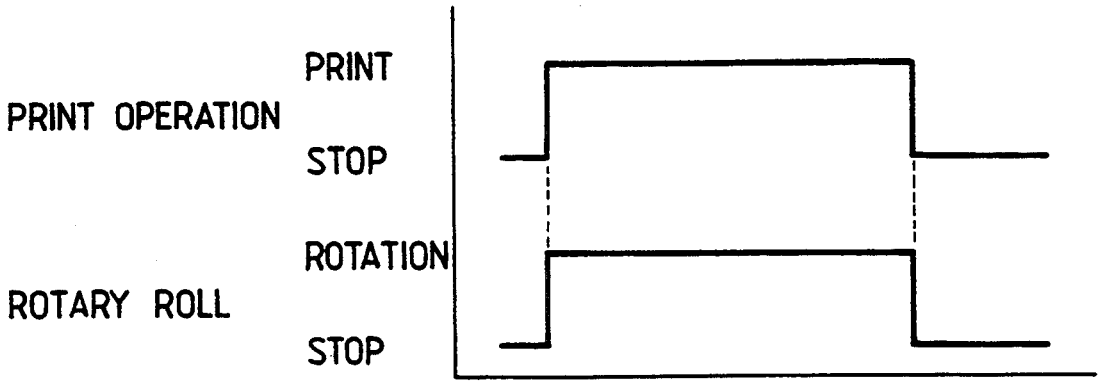
FIG. 4 PRIOR ART
FIG. 4 is a graph illustrating the relationship between the printing operation and the operation of a rotary roll in a conventional toner density detection method for an electrophotographic apparatus.

FIG. 1 shows the operational relationship between an electrophotographic apparatus and a rotary roll 3 in a preferred embodiment of the present invention. The structure of an apparatus for performing a toner density detection method according to the present invention is the same as that of the conventional apparatus. That is, the toner detection apparatus according to the present invention includes a permeability sensor 1, a special vessel 2 and a rotary roll 3. In the present invention, however, the rotary roll 3 is controlled so that the operation of the rotary roll 3 is continued for a predetermined length of time (e.g., several seconds) after the operation of the electrophotographic apparatus has been stopped. Accordingly, all or substantially all of the developing agent 6 is exhausted or removed from the special vessel 2 after the electrophotographic apparatus is stopped. The developing agent 6 is thus prevented from solidifying in the special vessel 2, and the true permeability of the developing agent can therefore be detected when the operation of the electrophotographic apparatus is restarted.

The predetermined period of time during which the operation of the rotary roll 3 is continued, after the electrophotographic apparatus is stopped, is equal to the time required for removing all or substantially all of the developing agent 6 out of the special vessel 2. The time may be determined, for example, on the basis of the size of the special vessel 2 and the rotational speed of the rotary roll 3.

According to the present invention, all or substantially all of the developing agent 6 is exhausted or removed from the special vessel 2 after the electrophotographic apparatus has been stopped, so that the true permeability of the developing agent can be detected when the operation of the electrophotographic apparatus is restarted. Accordingly, the toner density of the developing agent can be controlled and maintained at normal levels. As a result, the printing quality is stabilized.

We claim:

1. In a toner density detection apparatus for an electrophotographic apparatus including a developing agent comprising a mixture of toner and magnetic carrier in a predetermined proportion, a vessel having an aperture portion at its upper part and a developing agent outlet at its lower part and provided in a developer so that said developing agent is continuously supplied to said vessel, a permeability sensor provided inside said vessel for detecting a magnetic permeability of said developing agent, and a rotary roll provided at said developing agent outlet of said vessel for removing said developing agent in said vessel, a toner density detection method comprising the step of:

continuously driving said rotary roll for a predetermined length of time after said electrophotographic apparatus is stopped and until all or substantially all of the developing agent is exhausted from said vessel.

2. A toner density detection method as recited in claim 1, further comprising the step of:

calculating the predetermined length of time based on a size of said vessel and a rotational speed of the rotary roll.

3. A toner density detection method for detecting the density of a toner in a toner density detecting device of an electrophotographic apparatus, said method comprising the steps of:

stopping operation of the electrophotographic apparatus; and continuing operation of the toner density detecting device for a predetermined period of time after the electrophotographic apparatus is stopped and until all or substantially all of the toner is exhausted from the toner density detecting device.

* * * * *